United States Patent [19]

Suyama

[11] Patent Number: 4,601,176

[45] Date of Patent: Jul. 22, 1986

[54] WATER FROZEN AND WATER DEPLETION STATE SENSOR FOR AN ICE PRODUCT MAKING APPARATUS

[75] Inventor: Tomio Suyama, Toyoake, Japan

[73] Assignee: Hoshizaki Electric Co., Ltd., Toyoake, Japan

[21] Appl. No.: 664,143

[22] Filed: Oct. 24, 1984

[30] Foreign Application Priority Data

Nov. 14, 1983 [JP] Japan ..... 58-174762[U]

[51] Int. Cl.[4] ..... F25C 1/12

[52] U.S. Cl. ..... 62/138; 62/347

[58] Field of Search ..... 62/138, 137, 233, 347

[56] References Cited

U.S. PATENT DOCUMENTS

| | | | |
|---|---|---|---|
| 2,633,004 | 3/1953 | Leeson | 62/138 |
| 2,633,005 | 3/1953 | Lauer et al. | 62/138 |
| 2,645,095 | 7/1953 | Ploeger | 62/138 |
| 3,045,446 | 7/1962 | Thomas | 62/347 X |
| 3,049,894 | 8/1962 | Pichler et al. | 62/347 X |
| 3,430,452 | 3/1969 | Dedricks et al. | 62/138 |
| 4,363,220 | 12/1982 | Ripley | 62/138 |

*Primary Examiner*—William E. Tapolcai

*Attorney, Agent, or Firm*—Wenderoth, Lind & Ponack

[57] ABSTRACT

A unit for sensing the complete freezing and depletion of water, associated with an ice product making machine or apparatus which is comprised of a freezing plate formed of a lower heat conducting material and arranged vertically with a plurality of vertically extending and being transversely spaced apart partitions on its front surface and with surface portions between the adjoining partitions defining freezing sections, and a freezing system including a compressor adapted for supplying the cooling medium in circulation through a cooling coil placed on the back surface of the freezing plate. The sensing unit has a thermostatic temperature sensor mounted in direct contact with the foremost part of at least one of the partitions. The thermostat contact and the cooling system are so constructed and arranged that termination of ice making, is sensed by the thermostat temperature sensor sensing the temperature of the ice-making water approaching 0° C. and the depletion of water is also sensed by the thermostatic temperature sensor sensing an abrupt fall in temperature.

4 Claims, 4 Drawing Figures

WATER FROZEN AND WATER DEPLETION STATE SENSOR FOR AN ICE PRODUCT MAKING APPARATUS

BACKGROUND OF THE INVENTION

This invention relates to an ice product making machine or apparatus and more particularly to a simplified sensing system comprizing a thermostatic temperature sensor provided to the partitions of the freezing plate of the ice making machine or apparatus, by means of which the termination of ice making as well as the depletion of water can be sensed easily and reliably.

As the system of sensing that only ice (no water) is in the partitions of the freezing plate, or the termination of ice making, there are known a system in which the ice making time interval is controlled by a timer a system in which a decrease in the amount of the ice-making water in the ice-making water saucer is sensed as indicative the termination of ice making, and a system in which the vaporization temperature is sensed as indicative of the termination of ice making. These systems suffer from various deficiencies.

In the timer system and the system of sensing the decrease in the amount of ice-making water, it is not possible to sense the state of the water depletion simultaneously with the state of termination of ice making. Thus, a separate sensor must be provided to the sensing system with increased complexity in the circuit construction and elevated costs.

In the system of sensing the vaporization temperature, a sophisticated control circuit making use of electronic circuits must be provided to the system, again with increased complexity in servicing and elevated manufacture costs.

SUMMARY OF THE INVENTION

It is a principal object of the present invention to provide means for effectively overcoming the aforementioned various defects of the prior art. The present invention is characterized in that the thermostatic temperature sensor is connected at the peripheral part thereof to the foremost part of selected ones of a plurality of vertically extending rib-like partitions formed on the vertically arranged freezing plate, in such a manner that, at the time of termination of ice making, the ice-making water, the temperature of which is approximately 0° C., passing over an ice product of a sufficient size on the associated freezing section, is contacted directly with the thermostatic temperature sensor for sensing the temperature of the termination of ice making, and that, at the time of depletion of water such as is caused by suspension of the water supply, an abrupt fall in the temperature of the freezing plate caused by the failure in the supply of the ice-making water is sensed by the thermostatic temperature sensor.

DESCRIPTION OF THE PREFERRED EMBODIMENT

Figure 1:
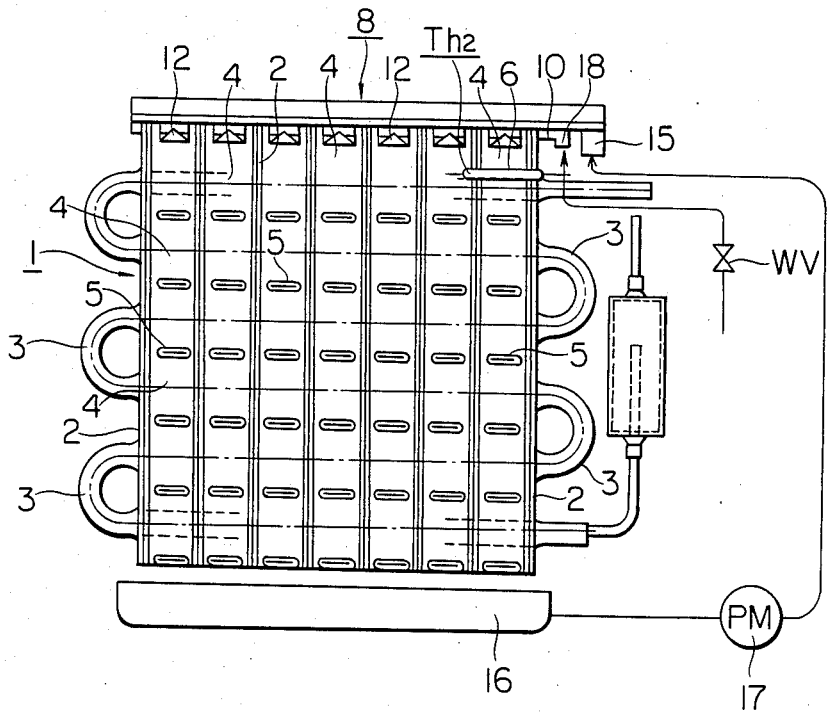
FIG. 1 is a schematic front view showing the overall structure of the ice making machine according to the present invention.
Figure 2:
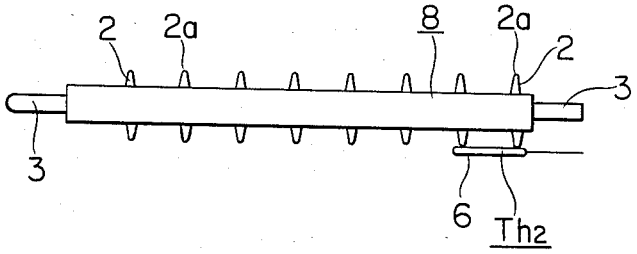
FIG. 2 is a plan view of the ice making machine shown in FIG. 1.

Referring to the embodiment of the present invention illustrated in the accompanying drawings, the ice product making and water depletion sensing device embodying the present invention is hereinafter explained in detail.

Referring to the drawing, the numeral 1 designates a pair of substantially vertically arranged freezing plates. On a front surface 1*a* of each freezing plate 1, which is formed of a material having a lower heat conductivity, such as stainless steel, there are formed a plurality of rib-like partitions 2 that extend vertically and at a constant transverse distance from one another.

On a back surface 1*b* of the freezing plate 1*b*, there is mounted a cooling coil 3 in such a manner that straight sections thereof extend one atop another with a constant pitch and at right angles with the partitions 2. Those portions of the front surface 1*a* which are defined between the adjoining partitions and are in register with the straight sections of the cooling coil 2 represent freezing sections 4 that are delimited from the vertically neighboring freezing sections by lugs 5 so as to permit the ice product to fall more easily during harvesting. The ice product making machine of this type is described more fully in our copending Japanese Patent Application No. 189290 - 1983 and U.S. pat. application Ser. No. 660,485, filed Oct. 11, 1984.

A tubular thermostatic temperature sensor $Th_2$ is mounted at a position substantially corresponding to a topmost freezing section 4 by a mounting bracket, not shown, in such a manner that the outer periphery 6 of the sensor $Th_2$ is in direct contact with the outer edge 2*a* of a pair of partitions 2 of the freezing plate 1 delimiting the topmost freezing section 4. The sensor $Th_2$ is mounted in this manner, that is, so that the outer periphery 6 of the sensor $Th_2$ is mounted astride the edge 2*a* of the partitions 2 and substantially in register with the topmost freezing section 4, in order that the thermostatic sensor $Th_2$ as well as a capillary tube or the like do not prove to be a hindrance to the released ice products 7. Also the thermostatic temperature sensor $Th_2$ has its center Q1 positioned slightly above the center Q2 of the semi-cylindrical ice product 7 having a radius R so that the formation of the semi-cylindrical ice product 7 on the freezing section 4 is terminated short of the thermostat sensor $Th_2$.

A water spray unit 8 is provided to the upper end of the freezing plate 1, and comprised of a spray section 9 for ice-making water and a spray section 10 for flushing or defrosting water which is formed integrally with and contiguous to the lower portion of the spray section 9. The spray unit 8 is securely mounted to the upper extremity of the freezing plate 1 by having a wall 10*a* of the flushing water spray section 10 affixed to the back surface 1*b* of the freezing plate 1. The spray unit 8 is formed with a holding plate 11 to which a deflector 12 having a substantially L-shaped cross section is attached in such a fashion that the ice making water discharged through spray apertures 13 of the ice making water spray section 9 may flow down along each freezing section 4 of the freezing plate 1 by way of the deflector 12. The lower portion of the flush water spray section 10 is provided with spray apertures 14 through which the flushing water is discharged and caused to flow down along the back surface lb of the freezing plate 1.

The ice making water spray section 9 has an ice-making water supply unit 15 to which the ice-making water stored in a water saucer 16 mounted beneath the freezing plate 1 is supplied by means of a circulating pump 17. The flushing water spray section 10 is provided with a flushing water supply unit 18 to which flushing or defrosting water is supplied by way of a water valve WV.

Figure 4:
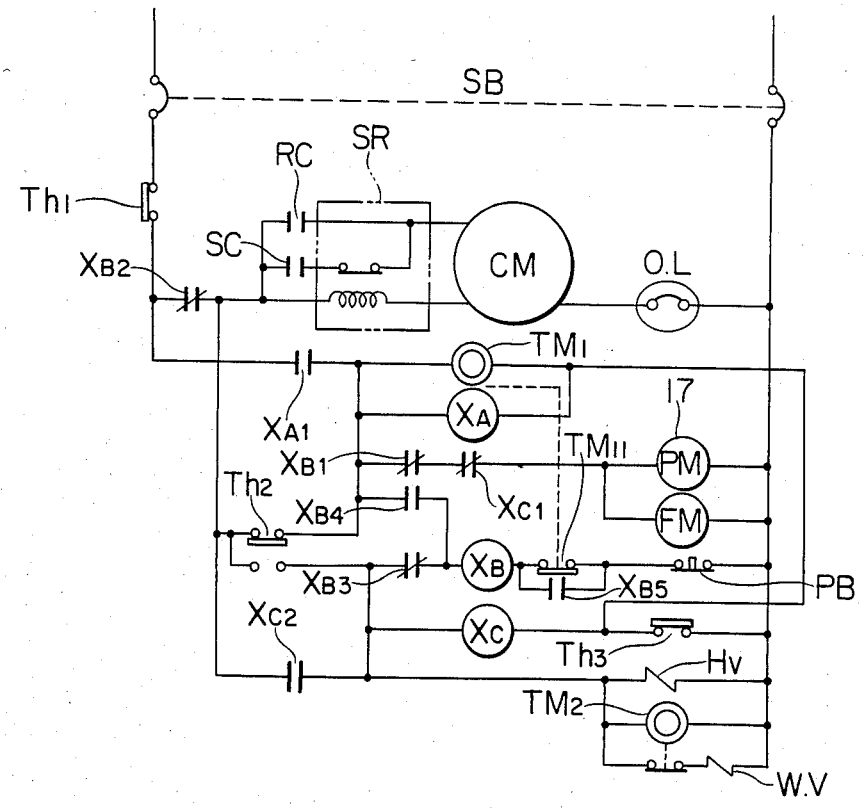
FIG. 4 is a diagram showing an electrical circuit for the frozen water and water depletion sensor according to the present invention.

Referring to FIG. 4 showing an electric circuit for the frozen water and water depletion sensing unit of the present invention, an ice storage thermostat $Th_1$ is connected to one of safety breakers SB of an electrical source, not shown, while a running condenser RC, a starting condenser SC and a contact $X_{B2}$ of a relay XB are connected to a compresser CM in a manner known per se. Relays $X_A$ and $X_B$ are connected to a 15-minute timer $TM_1$, while relays $X_B$ and $X_C$ are connected to the circulating pump 17 and to a fan motor FM. The thermostatic temperature sensor $Th_2$ used as an ice-making thermostat is connected to the relay $X_B$ connected in turn to a reset button PB, while a flushing or defrosting thermostat $Th_3$, a hot gas valve HV; a thermal timer $TM_2$ and the water valve WV are connected to the relay $X_C$.

Figure 3:
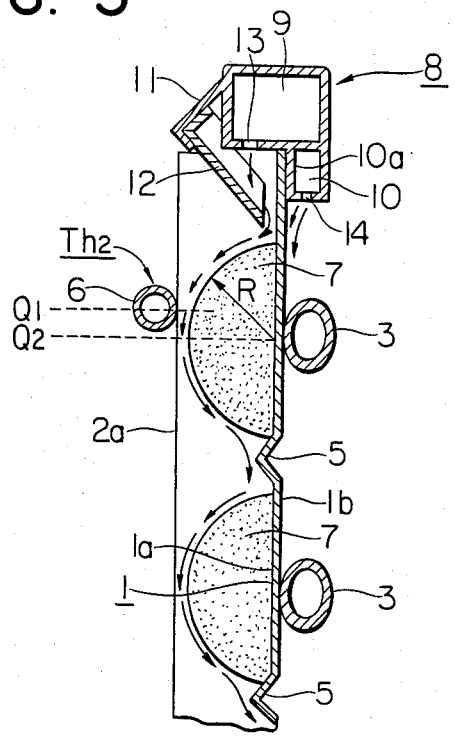
FIG. 3 is a cross-sectional view showing essential parts shown in FIG. 1.

The operation of the water frozen state and water depletion state sensing system of the present invention is now explained. Referring to FIG. 4, when the thermostatic sensor $Th_2$ is at the upper or ice-making position in the figure, the ice-making water in a water saucer 16 is caused to flow down along each freezing section 4 of the freezing plate 1 by way of the ice making water spray section 9 by the circulating pump 17 which is activated via normally closed contacts $X_{B1}$ and $X_{C1}$ of the relays $X_B$ and $X_C$. Also, the cooling medium or refrigerant is supplied to the cooling coil 3 by the compressor CM which is activated via normally closed contact $X_{B2}$ of the relay $X_B$. As a result thereof, a semi-cylindrical ice product 7 as shown in FIG. 3 is gradually formed on each freezing section 4 of the freezing plate 1. As the radius R of the ice product 7 approaches the height of the partition 2, the ice-making water discharged from the section 9 so as to flow down on the surface of the ice product 7 is directly contacted with the thermostatic temperature sensor $Th_2$. At this time, the ice-making water itself is approximately at a temperature of 0° C. and the temperature of 0° C. indicative of the termination of ice making is sensed by the sensor $Th_2$. Before the thermostatic temperature sensor $Th_2$ as the ice-making thermostat senses the termination of ice-making, a 15-minute timer $TM_1$, to which the electrical current has been supplied through normally open contact $X_{A1}$ of the relay $X_A$, has run through its preset timing interval, in such a manner that a normally closed contact $TM_{11}$ associated therewith is open and hence the thermostatic temperature sensor $Th_2$ is turned on for an interval of e.g. 30 minutes. Thus, the relay $X_C$ is energized and self-held by a normally closed contact $X_{C2}$ associated therewith so that the electrical current is supplied through hot gas valve HV, thermal timer $TM_2$ and water valve WV so as to initiate the ice harvesting cycle. The time interval during which the water valve WV is supplied with an electric current is controlled by a 90-second thermal timer $TM_2$. The flushing water supplied to the flushing water supply section 10 through water valve WV is received in the water saucer 16 via the back surface 1*b* of the freezing plate 1 so as to be used as the ice-making water during the next freezing cycle.

After the initiation of the harvesting cycle, the thermostatic temperature sensor $Th_2$ is again shifted to the upper position or the ice making side position. The harvesting cycle, however, is continued until the harvesting thermostat $Th_3$ is turned off and the normally closed contact $X_{C2}$ is open. Upon termination of the harvesting cycle, the relays $X_A$ and $X_C$ and the harvesting thermostat $Th_3$ are deenergized for initiating the next freezing or ice-making cycle.

When the ice-making water in the saucer has become depleted during the freezing step, as at the time of water supply suspension, the temperature of the freezing plate 1 is decreased abruptly before the 15-minute times $TM_1$ has run through its preset time period, so that the thermostat sensor $Th_2$ is activated and moved to the lower or ice product harvesting position. In this manner, the relay $X_B$ is energized through the normally closed contact $X_{B3}$ associated therewith and self-held by the normally open contacts $X_{B4}$ and $X_{B5}$, which are now closed, so that the compressor CM of the freezing circuit is turned off upon opening of the normally closed contact $X_{B2}$. In this manner, the state of depletion of the ice-making water can be sensed without resorting to any additional circuits.

In the above described construction and operation of the frozen water and water depletion sensing device of the present invention, the thermostatic temperature sensor securely provided to the edges of the partitions can sense that the ice-making water has reached the temperature of 0° C. indicative of the termination of the ice-making step. The thermostatic temperature sensor is fitted to the topmost portion of the freezing plate, so that it does not prove to be a hindrance to the ice product release operation. Moreover, when the supply of the ice-making water has become depleted during the freezing step, the sudden decrease in the temperature of the freezing plate may be sensed in a shorter time than in the case of the conventional freezing apparatus and without the necessity of employing any additional sensing circuit. In addition, since a thermostat designed to be turned off at about 0° C. is used in general as the thermostat $Th_1$ which senses the amount of ice stored in an ice reservoir of the ice product making machine or apparatus, the thermostat of the same design as the ice storage thermostat may also be used as the ice-making thermostat.

It should be noted that, although the thermostatic temperature sensor $Th_2$ is mounted to the right side topmost portion of the freezing plate 1 in FIG. 1 in the present embodiment, similar results may also be achieved by providing the sensor to the left side uppermost portion of the freezing plate.

What is claimed is:

1. In an apparatus for making semi-cylindrical ice products, including a substantially vertically extending freezing plate having opposite vertically extending side edges, a front face, a rear face opposite said front face and a plurality of vertically extending horizontally spaced apart partitions on said front face between said opposite side edges, said partitions projecting a predetermined distance outwardly of said front face, surface portions of said front face between said partitions each defining respective pluralities of vertically aligned freezing sections, and means for freezing water into semi-cylindrical ice products of radius less than said predetermined distance during a freezing cycle on, and harvesting ice products during a harvesting cycle from said surface portions, one ice product on and from each freezing section, said freezing means including a cooling coil provided on said back surface of said freezing plate across each of said freezing sections, and a compressor for circulating a cooling medium through said cooling coil so as to freeze the semi-cylindrical ice products centered over said cooling coil in said freezing sections, and a frozen water and water depletion sensing unit, the improvement wherein:

said sensing unit includes a thermostatic temperature sensor having thermostatic contacts, mounted on said freezing plate astride two side-by-side ones of said partitions immediately adjacent to one of said opposite side edges, over the topmost freezing section of the plurality of freezing sections between said side-by-side ones of said partitions at a position over and at least as high as the portion of said cooling coil across said topmost freezing section, so as to contact water flowing downward over said front face in spaced relation to the ice product being formed in said topmost freezing section all along the length of said sensor, and means, connected to said contacts and responsive to the temperature sensed by said sensor, for terminating said freezing cycle when the temperature sensed by said sensor reaches a preset temperature value.

2. The improvement as in claim 1, wherein said sensor is disposed slightly above the portion of said freezing coil across said topmost freezing section.

3. In an apparatus for making semi-cylindrical ice products, including a substantially vertically extending freezing plate having opposite vertically extending side edges, a front face, a rear face opposite said front face and a plurality of vertically extending horizontally spaced apart partitions on said front face between said opposite side edges, said partitions on said front face between said opposite side edges, said partitions projecting outwardly of said front face, surface portions of said front face between said partitions each defining respective pluralities of vertically aligned freezing sections, and means for freezing water into semi-cylindrical ice products of predetermined radius during a freezing cycle on, and harvesting ice products during a harvesting cycle from said surface portions, one ice product on and from each freezing section, said freezing means including a cooling coil provided on said back surface of said freezing plate across each of said freezing sections, and a compressor for circulating a cooling medium through said cooling coil so as to freeze the semi-cylindrical ice products centered over said cooling coil in said freezing sections, and a frozen water and water depletion sensing unit, the improvement wherein:

said sensing unit includes a thermostatic temperature sensor having thermostatic contacts, mounted on said freezing plate astride two side-by-side ones of said partitions immediately adjacent to one of said opposite side edges, over the topmost freezing section of the plurality of freezing sections between said two side-by-side ones of said partitions slightly above the portion of said freezing coil across said said topmost freezing section, so as to contact water flowing downward over said front face at a distance more than said predetermined radius from the radial center of the ice product being formed in said topmost freezing section, and means, connected to said contacts and responsive to the temperature sensed by said sensor, for terminating said freezing cycle when the temperature sensed by said sensor reaches a preset temperature value.

4. The improvement as in claim 3, wherein said partitions extend outwardly of said front face a predetermined distance greater that said predetermined radius.

* * * * *